US005399115A

United States Patent [19]

Arad et al.

[11] Patent Number: 5,399,115

[45] Date of Patent: Mar. 21, 1995

[54] BLINKING DOLL WITH POWER STORAGE MECHANISM

[75] Inventors: Avi Arad, Westport, Conn.; Robert W. Jeffway, Jr., Northhampton, Mass.

[73] Assignee: Toy Biz, Inc., New York, N.Y.

[21] Appl. No.: 239,275

[22] Filed: May 6, 1994

Related U.S. Application Data

[63] Continuation of Ser. No. 925,094, Aug. 4, 1992, abandoned.

[51] Int. Cl.[6] ..... A63H 3/46; A63H 3/40

[52] U.S. Cl. ..... 446/342; 446/384; 446/484

[58] Field of Search ..... 446/330, 342, 337, 343, 446/345, 347, 348, 349, 351, 352, 353, 384, 383, 381, 376, 389, 391, 392, 393, 395, 484, 485

[56] References Cited

U.S. PATENT DOCUMENTS

| | | | |
|---|---|---|---|
| 1,582,778 | 4/1926 | Parsons | 446/395 X |
| 1,831,602 | 11/1931 | Maby | 446/342 |
| 2,616,216 | 11/1952 | Fraysur | 446/342 |
| 2,641,866 | 6/1953 | Schiller | 446/342 |
| 2,660,830 | 12/1953 | Jentzen | 446/342 |
| 3,124,901 | 3/1964 | Beebe | 446/383 |
| 3,492,760 | 2/1970 | Nishitani | 446/484 X |
| 3,494,323 | 2/1970 | Ayala et al. | 446/391 X |
| 3,512,298 | 5/1970 | Poynter | 446/484 X |
| 3,699,707 | 10/1972 | Sapkus | 446/342 X |
| 3,740,039 | 6/1973 | Prola | 446/342 X |
| 4,177,589 | 12/1979 | Villa | 446/342 X |
| 4,236,347 | 12/1980 | Fauls | 446/384 X |
| 4,708,689 | 11/1987 | Hou | 446/342 X |
| 4,900,289 | 2/1990 | May et al. | 446/342 |
| 5,052,969 | 10/1991 | Smith | 446/485 X |
| 5,118,319 | 6/1992 | Smith et al. | 446/485 X |

FOREIGN PATENT DOCUMENTS

| | | | |
|---|---|---|---|
| 2019343 | 11/1992 | WIPO | 446/342 |

*Primary Examiner*—Robert A. Hafer
*Assistant Examiner*—D. Neal Muir
*Attorney, Agent, or Firm*—Amster, Rothstein & Ebenstein

[57] ABSTRACT

A doll with an eyeblink mechanism includes an eye with a reciprocatable eyelid, a drive providing intermittent slow rotary motion, and a torsion spring for accumulating such rotary motion, as necessary, and converting each predetermined quantity of such rotary motion into intermittent, relatively rapid reciprocating motion of the eyelid to blink the eye. A safety mechanism precludes overwinding of the torsion spring, e.g., when movement of the eyelid is physically blocked.

9 Claims, 7 Drawing Sheets

BLINKING DOLL WITH POWER STORAGE MECHANISM

This is a continuation of application Ser. No. 07/925,094, filed on Aug. 4, 1992, now abandoned.

BACKGROUND OF THE INVENTION

The present invention relates to a doll with an eyeblink mechanism, and more particularly to such a doll with such an eyeblink mechanism including a safety mechanism to preclude overwinding.

A "talking" doll which is capable of emitting sounds (such as speech) is commonly provided with a drive mechanism which moves the doll mouth (and in particular the lips thereof) so that the doll appears to be talking. However, this illusion would be lost if the mouth continued to move even when the doll was silent. Accordingly, the drive mechanism for moving the mouth is preferably actuated by or with the mechanism for generating speech and thus operates intermittently, only while the doll is talking. Additionally, the intermittent motion produced by the drive mechanism is typically relatively slow since the movement of the doll mouth is intended to mimic the mouth of a person speaking.

It is also known to provide a doll which has eyes that appear to blink because periodically the eyelids rapidly lower (to close the eyes) and rise (to open the eyes), thereby simulating an eyeblink. However, it is difficult to realistically simulate an eyeblink. Real eyes normally do not blink at regular, well-established time intervals, and thus doll eyes which blinked only at regular intervals would not appear realistic. Further, an eyeblink is a relatively rapid motion, relative to the usual movement of the lips during human speech. Accordingly, if the eyeblink mechanism of a "talking" doll is to be run off the same drive mechanism which moves the mouth of the talking doll, the eyeblink will appear slower than would be realistic. Finally, a real eyeblink does not stop in the middle, but sweeps back and forth between a fully eye-opened position and a fully eye-closed position, the complete eyeblink cycle being open-close-open. If the eyeblink mechanism is run off the mouth-drive mechanism of a talking doll, if the speech of the doll happens to terminate in the middle of a blink, then the eyelid will either stop in an interim position (with the eye neither fully opened nor fully closed) or perform only a partial blink (i.e., not fully closing the eye), thus providing an unrealistic appearance.

Additionally, the known eyeblink mechanisms frequently become broken as a result of a user either intentionally or accidentally holding an eyelid of the doll in such a manner that the eye is prevented from blinking when the eyeblink mechanism is trying to blink the eye, with resultant damage to the eyeblink mechanism.

It is also well known to provide a doll with a mechanical neck switch such that a play feature may be "kiss"-initiated—in other words, the backward tilting of the head relative to the torso (as would naturally occur when a child kisses the doll on the lips) causes the neck to pivot rearwardly on a pivot pin and thereby close a switch which initiates the play feature. The commonly used neck pivot pin limits the amount of head rotation possible, limiting articulation in any axis. Additionally, the neck pivot pin is typically not very sturdy or resistant to wear and thus may break, with the result that the play feature either cannot be initiated or cannot be turned off once begun.

Accordingly, it is an object of the present invention to provide a doll with an eyeblink mechanism which is realistic.

Another object is to provide such a doll which includes safety means for preventing or minimizing damage to the eyeblink mechanism when the eyeblink is physically restrained by the user.

A further object is to provide a talking doll with an eyeblink mechanism which operates off the same drive as that which moves the mouth of the doll, but blinks the eye in a realistic manner at irregular intervals and with full blinks.

It is also an object of the present invention to provide a a doll having an improved kiss-initiated neck switch.

It is a further object to provide a doll with such a neck switch which enables limited head rotation, limited articulation of the head in any axis, and limited telescopic action of the head relative to the body.

It is a further object to provide a doll with such a neck switch which is characterized by a high level of strength to resist breakage.

SUMMARY OF THE INVENTION

It has now been found that the above and related objects of the present invention are obtained in a doll with an eyeblink mechanism. The doll comprises an eye with a reciprocatable eyelid and means for providing intermittent slow rotary motion. According to the present invention, means are provided for accumulating such rotary motion, as necessary, and converting each predetermined quantity of such rotary motion into intermittent, relatively rapid reciprocating motion of the eyelid to blink the eye.

In a preferred embodiment, the accumulating means comprises torsion spring means which is wound by the rotary motion when the reciprocating motion is blocked and unwound by the conversion of such rotary motion to such reciprocating motion. The accumulating means additionally includes means for releasably blocking such reciprocating motion until a predetermined quantity of rotary motion is accumulated and safety means for precluding overwinding of the torsion spring means.

Where the doll is a talking doll having a movable mouth and a mouth-driving mechanism for moving the mouth in general coordination with the talking of the doll, the mouth-driving mechanism is driven by the motion providing means.

The present invention further encompasses a doll with an eyeblink mechanism, comprising an eye with a reciprocatable eyelid. Also provided are rotary disk means and drive means for intermittently slowly rotating the rotary disk means in a given direction. Rotatable crank disk means intermittently relatively rapidly reciprocate the eyelid when the crank disk means rotates, thereby to blink the eye. Fixedly disposed stop means is engageable with the crank disk means for normally precluding rotation of the crank disk means, biasing means bias the stop means and the crank disk means into engagement, and torsion spring means is secured to both the rotary disk and the crank disk means for developing torque therebetween and causing relatively rapid rotation of the crank disk means in a given direction when the engagement of the stop means and the crank disk means is released. Means are provided for overcoming the biasing means once per revolution of the rotary disk means, thereby to release the engagement between the stop means and the crank disk means and thus permit rotation of the crank disk means and blinking the eye once per revolution of the rotary disk means.

In a preferred embodiment, the doll additionally includes a safety mechanism for precluding overwinding of the torsion spring means. The safety mechanism includes a soft connection between the crank disk means and the eyelid which enables rotation of the crank disk means without reciprocating the eyelid, and means for causing a full rotation of the crank disk means at least once per full rotation of the rotary disk means regardless of whether or not rotation of the crank disk means reciprocates the eyelid.

Where the doll is a talking doll including a movable mouth, the drive means also moves the mouth in general coordination with the talking.

The present invention also encompasses a doll with a neck switch comprising a head portion defining a flange, a body portion defining a flange, and a neck portion intermediate the head and body portions. The body flange overlaps the head flange within the neck portion and precludes separation of the head and body portions. The neck portion including means biasing the head and body portions apart, and a push switch mounted on one of the head and body portions, so that forcible tilting of the head portion relative to the body portion in a given direction overcomes the biasing means and causes the flange of the other of the head and body portions to push the head flange against the switch to actuate the same.

In a preferred embodiment, the head flange and the body flange are interlocked concentric members extending substantially about the full circumference of the neck portion, the neck portion enabling at least limited rotation of the head portion relative to the body portion, at least limited articulation of the head portion relative to the body portion in any axis, and limited telescopic action of the head and body portions. The doll has a front and a rear, with the switch being disposed adjacent the rear of the doll and remote from the front of the doll, and the given direction being rearwardly.

Optionally the doll additionally includes a lever having a first end secured to either of the head and body portions and a second end disposed intermediate the switch and the flange of the other of the head and body portions (i.e., the one on which the switch is not mounted). Thus, forcible tilting of the head portion relative to the body portion in a given direction overcomes the biasing means and causes the flange of the other of the head and body portions to push the second lever end against the switch to actuate the same. Preferably the first lever end is secured to either of the head and body portions adjacent the front of the doll, and the second lever end is disposed intermediate the switch and the flange of the other of the head and body portions adjacent the rear of the doll. More particularly, the switch is mounted on the body portion, and the second lever end is disposed intermediate the switch and the head flange.

Finally, the present invention further encompasses a doll with an eyeblink mechanism and a neck switch. The doll comprises a head portion defining a flange and an eye with a reciprocatable eyelid, means for providing intermittent slow rotary motion, and means for accumulating such rotary motion, as necessary, and converting each predetermined quantity of such rotary motion into intermittent, relatively rapid reciprocating motion of the eyelid to blink the eye. The doll also includes a body portion defining a flange, and a neck portion intermediate the head and body portions. The body flange overlaps the head flange within the neck portion and precludes separation of the head and body portion. The neck portion includes means biasing the head and body portions apart, and a push switch mounted on one of the head and body portions, so that forcible tilting of the head portion relative to the body portion in a given direction overcomes the biasing means and causes the flange of the other of the head and body portions to push the switch to actuate the same.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
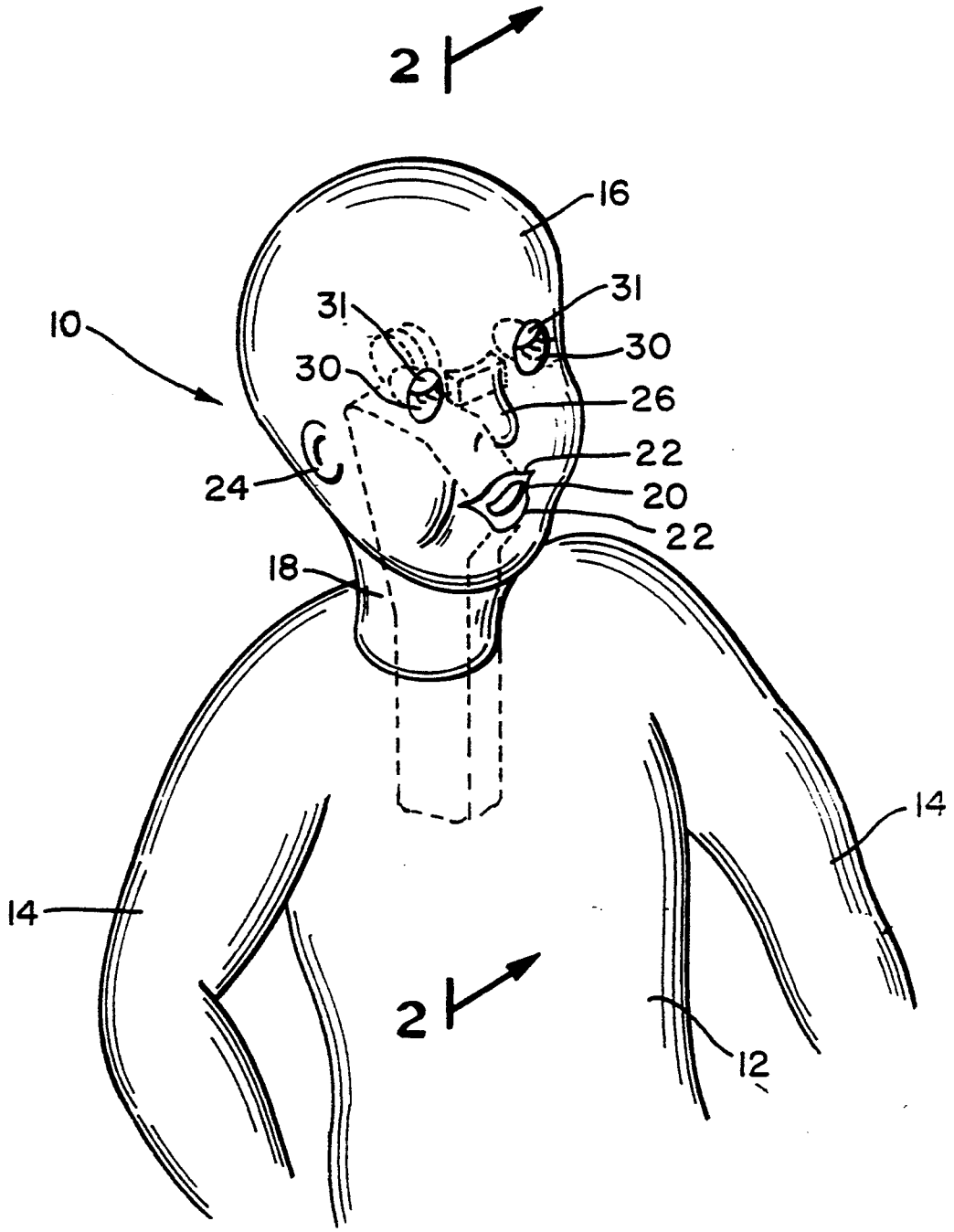
FIG. 1 is a fragmentary isometric view of a doll according to the present invention.
Figure 2:
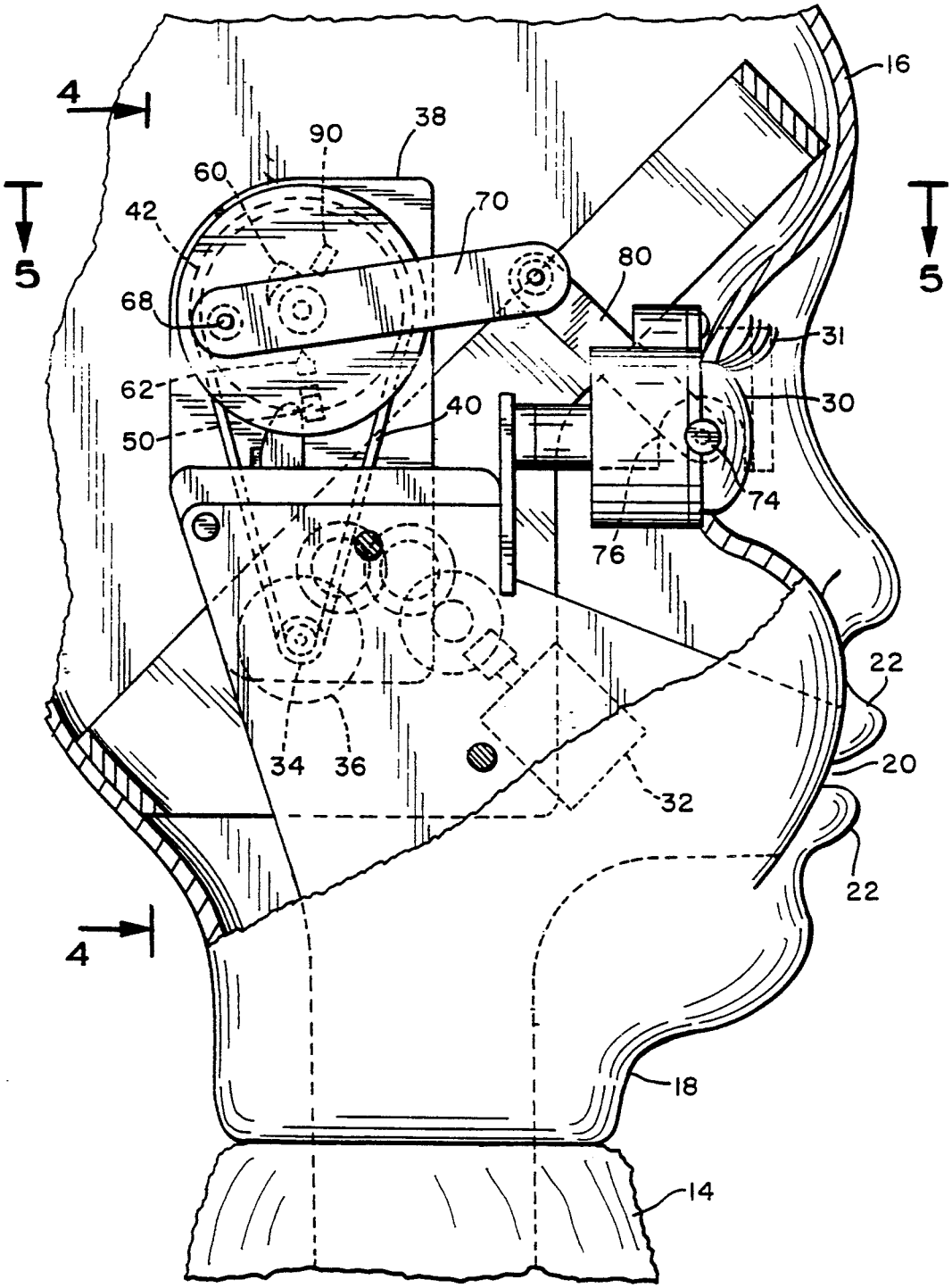
FIG. 2 is a fragmentary sectional view thereof taken along the line 2—2 of FIG. 1, showing the eye in an open position.
Figure 3:
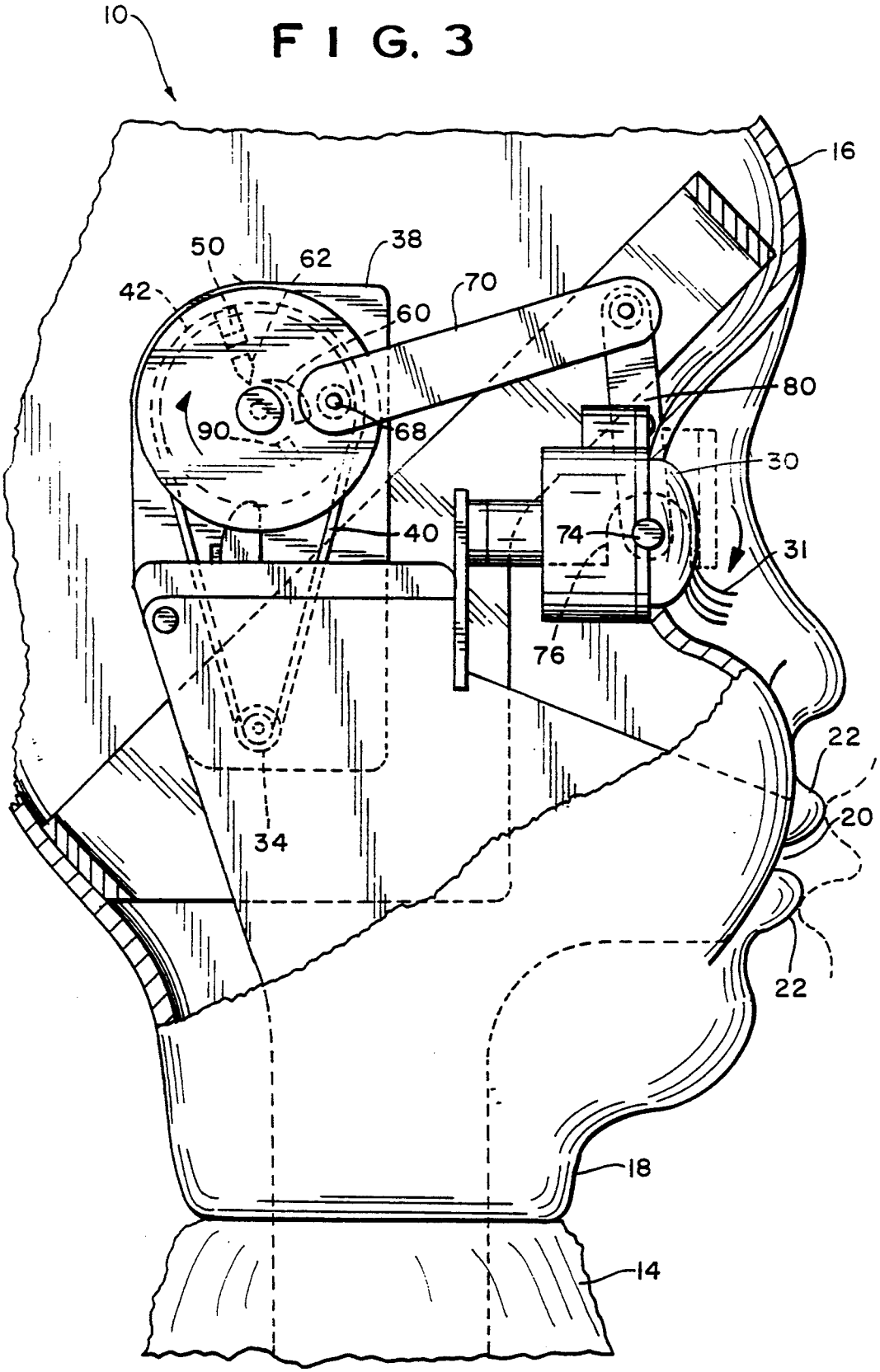
FIG. 3 is a fragmentary sectional view similar to FIG. 2, but showing the eye in a closed position.
Figure 4:
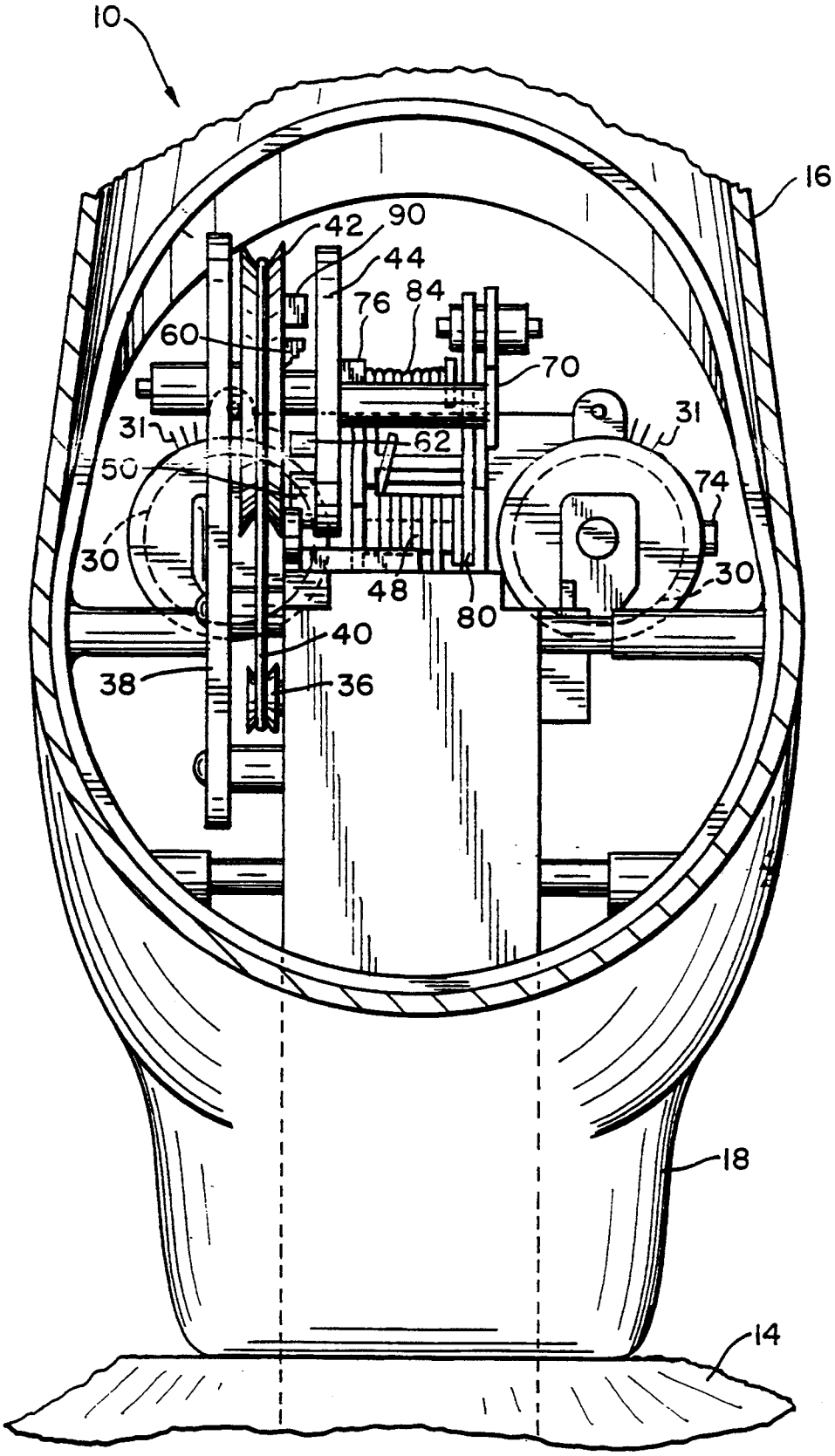
FIG. 4 is a fragmentary sectional view taken along the line 4—4 of FIG. 2.
Figure 5:
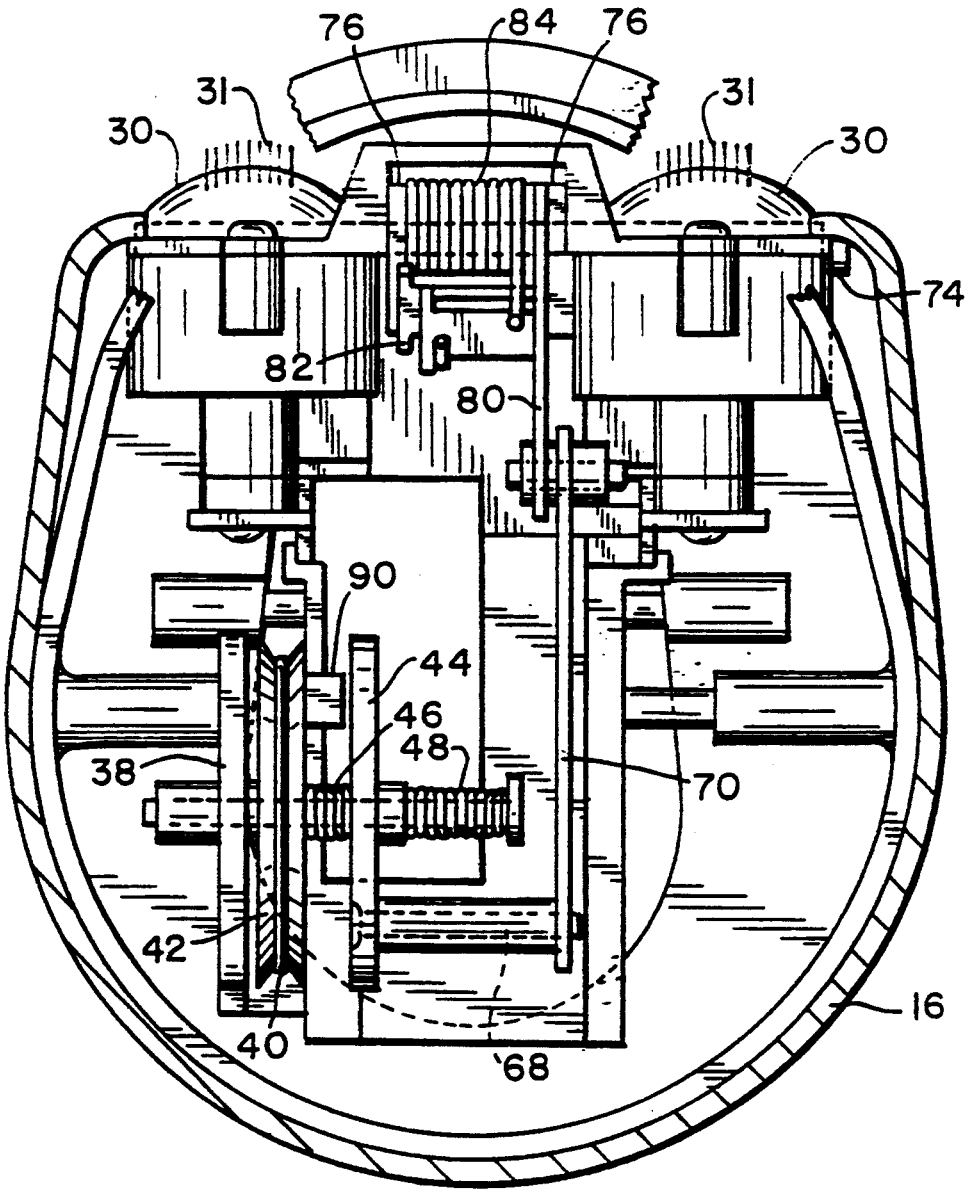
FIG. 5 is a fragmentary sectional view taken along the line 5—5 of FIG. 2.

Referring now to FIG. 1, therein illustrated is a doll according to the present invention, generally designated by the reference numeral 10. The doll includes a torso 12, a pair of arms 14 depending from the torso 12 and optionally movable relative thereto, optionally a pair of legs (not shown) fixedly or pivotably secured to the torso 12, and a head 16 pivotably secured to the torso 12. The head 16 includes a neck 18, a movable mouth 20 (defining a pair of lips 22), ears 24, a nose 26 and a pair of eyes 30 (each including a movable eyelid 31).

The doll 10 is a talking doll and, as the doll speaks, the mouth 20 is operated in synchronization with the speech pattern (as played through the speaker) in order to mimic human lip movement. This is a conventional process wherein the speech microprocessor (which generates the speech) controls a transistor switch which in turn controls the flow of current from a battery through an electric motor, depending upon the presence or absence of speech production at a given moment. Torque from the electric motor is applied to a gear train assembly which reduces the speed of the motor and multiplies the torque in order to drive a crank gear which, along with a mouth-connection link and rocker lever, converts the rotary motion from the electric motor into reciprocating motion. This reciprocating motion is coupled to the doll's mouth and causes the mouth to move in a lifelike manner while the doll is speaking. The motor is run only intermittently, in synchronization with the speech, so that it appears that the lips are moving along with the spoken words. As the mechanism for moving the mouth of the doll in coordination with the talking of the doll is well known and conventional in the doll art, the mechanism is not specifically disclosed in the drawing and need not be set forth herein in any further detail.

Figure 6:
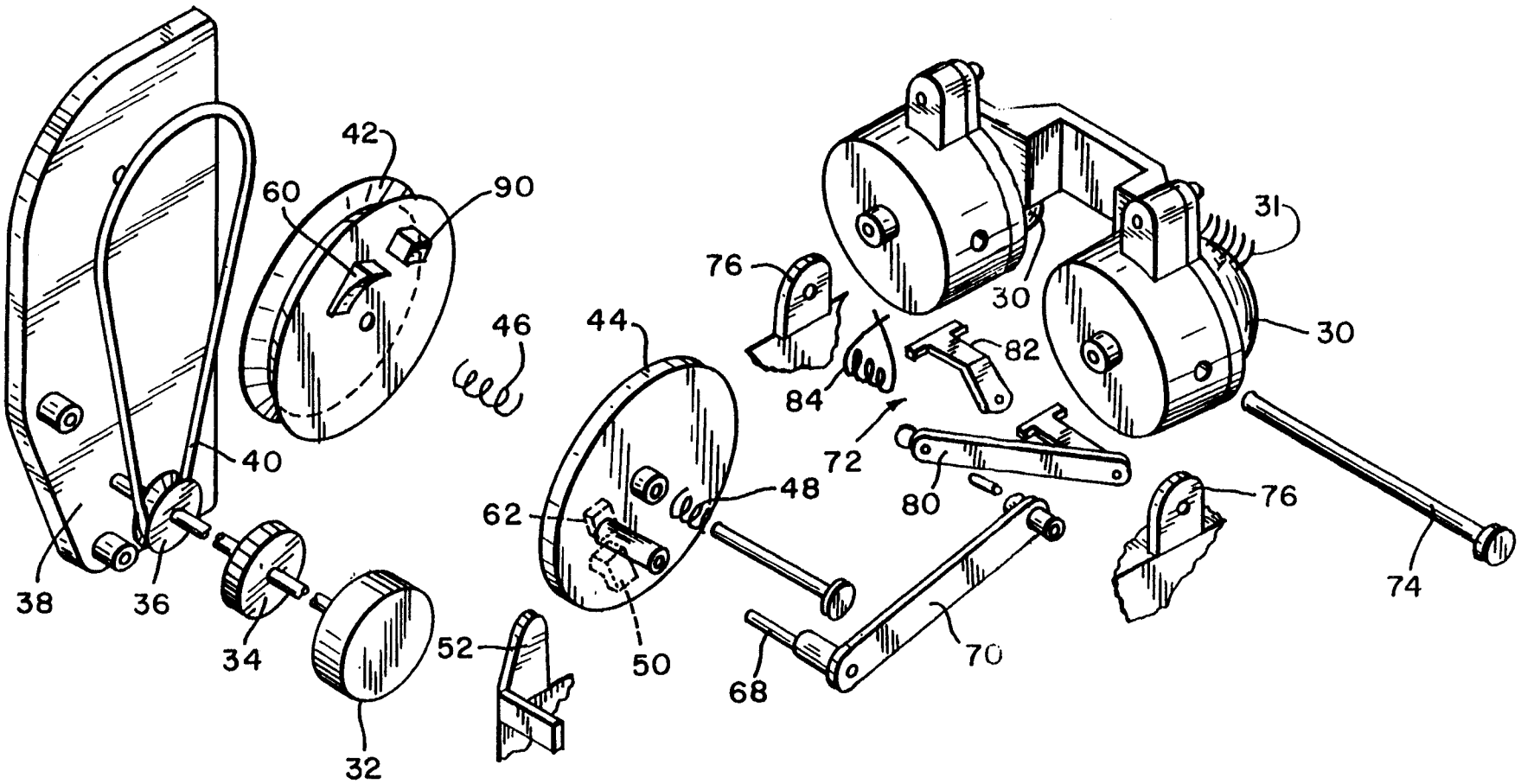
FIG. 6 is an exploded isometric view of the eyeblink mechanism.

Referring now in particular to FIG. 6, the same motor 32 used to produce movement of the mouth 20 in synchronization with the speech, also provides intermittent rotary motion, through a reduction gear train schematically indicated at 34, to a driving pulley 36 mounted on an eyeblink bracket 38. The driving pulley 36 drives a belt 40, which in turn drives a belt disk 42. The pulley/belt/disk system 36, 40, 42 provides both a reduction of speed and a torque multiplication, with the rotary motion from belt disk 42 providing the energy for the eyeblink mechanism as described hereinafter.

A crank disk 44, coaxial with and laterally offset from the belt disk 42, is connected thereto for rotation therewith by a torsion spring 46 extending along the common axis therebetween. A compression spring 48 acting along the common axis forces a stop 50 on crank disk 44 against a stationary catch 52, thereby to keep the crank disk 44 stationary at the beginning of the eyeblink sequence. Accordingly, as belt disk 42 is from time to time intermittently slowly but forcefully rotated by belt 40, torsional energy becomes stored in torsion spring 46 (since catch 52 acting on stop 50 precludes similar rotation of crank disk 44). Eventually, with continued rotation of belt disk 42 relative to crank disk 44, the ramp 60 of belt disk 42 acts on the follower 62 of the crank disk 44, forcing the crank disk 44 to move laterally against the bias of compression spring 48 and thereby releasing the crank disk stop 50 from the stationary catch 52. Once the stop 50 is released from the catch 52, the crank disk 44 is rapidly rotated through a complete rotation by the stored torsional energy of torsion spring 46, which is now free to rotate crank disk 44 relative to belt disk 42 until catch 52 once again engages stop 50.

As the crank disk 44 rotates, the rotary motion thereof is converted to a reciprocating motion by means of a crank pin 68 mounted thereon and a connecting link 70 secured to the crank pin 68. This reciprocating motion is transmitted, via a so-called "soft connection" or safety spring mechanism generally designated 72, to the eyelids 31 to blink eyes 30 mounted on a pin 74.

The safety mechanism 72 is mounted intermediate a pair of stationary safety mechanism brackets 76 and includes a safety spring driver lever 80 which is acted upon by the crank lever 70, a safety spring driven lever 82 which is directly connected to the eyelids 31 to reciprocate the same, and a safety spring 84 mounted on a common axis with the driving lever 80 and driven lever 82 and normally causing the movement of the driving lever 80 to be transmitted to the driven lever 82. However, in the event that the eyelids 31 are held stationary by the user, thereby preventing an eyeblink, the safety spring 84 will be stressed by the movement of the driving lever 80 since the driven lever 82 is immobilized by the immobilization of the eyelids 31. However, while the safety spring 84 normally connects the driving lever 80 and the driven lever 82 so that the driven lever 82 moves as a unit with the driving lever 80, where the driven lever 82 is immobilized, the driving lever 80 is capable of overcoming the force of the safety spring 84 joining the two for movement as a unit so that the driving lever 80 can move through its normal course even when the driven lever 82 is blocked from movement through its normal course. To permit this, under stress the free ends of the safety spring 84 separate, thereby leaving room for the portion of the driving lever 80 therebetween to move relative to the driving lever 82.

This safety mechanism is important because it precludes overstressing of torsion spring 46. To take advantage of this safety mechanism, the adjacent surfaces of the belt disk 42 and crank disk 44 define a safety post 90 and a safety stop 92, respectively. The safety post 90 engages the safety stop 92 whenever the engagement of the ramp 60 of the belt disk 42 and the follower 62 of the crank disk 44 has been unable to release the torsional tension in torsion spring 46 (typically because the eyelid movement is blocked). Thus the safety post 90 of belt disk 42 forces the safety stop 92 of crank disk 44 to force crank disk 44 through a complete revolution, thereby to prevent the torsion spring 46 from being wound more than one revolution at any time. This forcing of crank disk 44 through a complete revolution in turn tensions and then relaxes the safety spring 84 (by enabling movement of driving lever 80 relative to driven lever 82 when the eyelids 31 are blocked from movement), thereby preventing damage to the eyeblink mechanism. It will be appreciated that, as long as there is no blockage of the eyeblink mechanism, the safety post 90 and safety stop 92 never engage and the safety spring 84 causes the driven lever 82 to move with the driving lever 80.

The mechanism described above causes the eyes intermittently to "blink" abruptly in a lifelike fashion, undergoing a full open to full close and back to full open movement, even while the motor 32 and mouth 20 is undergoing only intermittent operation. The mechanism allows the accumulation of the intermittent rotary motion from motor 32 (occurring only during talking of the doll) to be accumulated until there is a predetermined quantity of rotary motion sufficient to effect a full eyeblink cycle. Accordingly, the eyeblinks occur not in any fixed time interval, but rather at times determined at least in part by the amount of speech which has occurred since the last eyeblink. Ordinarily there is no correlation between the timing of the intermittent rotary motion of the motor 32 and/or mouth 20 with the intermittent reciprocating motion of the eyelids 31.

Figure 7:
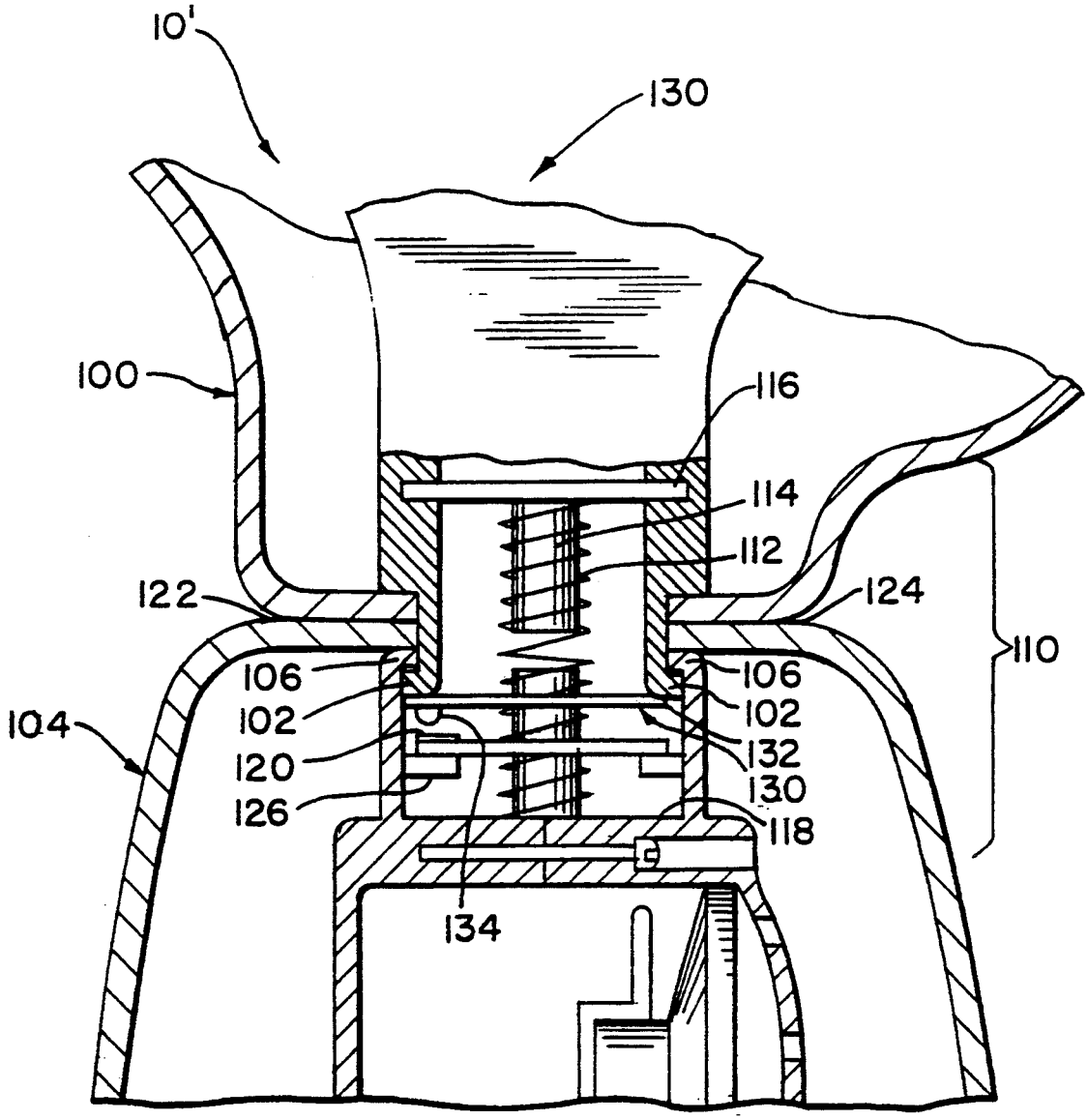
FIG. 7 is a fragmentary sectional view of the neck portion of the doll revealing the neck switch.

Referring now to FIG. 7, therein illustrated is a doll 10' according to the present invention. The doll 10' may be a doll 10 having an eyeblink mechanism as described above or a different doll not having such an eyeblink mechanism. The doll 10' comprises a head portion generally designated 100 defining a flange 102, a body portion generally designated 104 defining another flange 106, and a neck portion generally designated 110 intermediate the head portion 100 and the body portion 104. The body flange 106 and the head flange 102 overlap one another within the neck portion 110 and thereby preclude separation of the head and body portions 100, 104. More particularly, the head flange 102 and body flange 106 are interlocked concentric members extending substantially about the full circumference of the neck portion 110 so that the neck portion 110 enables at least limited rotation of the head portion 100 relative to the body portion 104 and at least limited articulation or tilting of the head portion 100 relative to the body portion 104 in any axis. And, of course, there is a limited vertical movement possible between the neck and head portions 100, 104 (that is, a relative telescoping or untelescoping movement of the head and neck portions 100, 104 relative to one another). As illustrated, the head flange 102 extends outwardly, and the body flange 106 extends inwardly, although clearly the directions of the flanges could be reversed.

The neck portion includes means 112 (such as a compression spring) biasing the head and body portions 100, 104 apart. Preferably the biasing means or spring 112 is coiled around a spring holder member or post 114, with the upper end of the biasing means 112 bearing against the neck portion 100 (and in particular a neck plug 116) and the other end of the biasing means 112 bearing against the body portion 104 (and in particular a body plug 118). The biasing means 112 not only biases the head and body portions 100, 104 apart, but tends to maintain the head portion 100 upright on the body portion 104 without tilting.

The neck portion 110 additionally includes a push switch 120 mounted on one of the head and body portions 100, 104 by a support 126. While the push switch 120 is illustrated as being mounted on the body portion 104, adjacent the rear 122 of the doll, alternatively it could be mounted on the head portion 100 adjacent the front 124 of the doll. The head portion 100 may be forcibly tilted rearwardly and downwardly (in the direction of arrow 130) relative to the body portion 104, so as to overcome the biasing means 112 tending to maintain the head portion 100 upright on the body portion 104, by a child kissing the lips of the doll. The forcible tilting causes the head flange 102 at the rear 122 of the doll to approach the push switch 120 and directly or indirectly actuate the same.

It will be appreciated that the construction described above provides a head/body interlock of substantial strength since it is comprised of interlocked concentric members (that is, the body flange 106 and the head flange 102), the level of strength and resistance to damage being substantially higher than that provided by the prior art neck pivot pin used for enabling the head portion to be pivoted rearwardly relative to the body portion. Additionally, the design of the present invention allows at least a limited rotation of the head portion relative to the body portion and at least limited articulation or tilting of the head portion relative to the body portion in any axis. Additionally, there is enabled a slight but appreciable vertical movement of the head portion relative to the body portion (that is, a telescoping or untelescoping action).

The construction described above is, however, subject to damage if the head portion 100 is tilted far back relative to the body portion 104 so that the head flange 102 is tightly pressed against the push switch 120 and the child then rotates the head portion 100 back and forth relative to the body portion 104. Such a twisting action tends to cause the switch 120 to separate from its support 126, in effect disabling the doll from performance of the switch-initiated action (e.g., talking). In order to overcome this problem, a lever or switch arm generally designated 130 is preferably disposed in the neck portion 110. The lever 130 has a first end 132 secured to one of the head and body portions 100, 104 and a second or free end 134 disposed intermediate the switch 120 and the flange of the lead or body portion not supporting the switch 120. In other words, where the switch 120 is mounted on the body portion 104 (as illustrated), then the second or free end 134 is disposed intermediate the switch 120 and the head flange 102 adjacent the rear 122 of the doll.

Preferably, the switch 120 is disposed adjacent the rear 122 of the doll and remote from the front 124 of the doll, the first lever end 132 is secured to either one of the head and body portions 100, 104 adjacent the front 124 of the doll, and the second or free lever end 134 is disposed intermediate the switch 120 and the flange 102, 106 of the head or body portion which does not support the switch 120 adjacent the rear 122 of the doll. Optimally, the first lever end 132 is secured to the head flange 102 and the second lever end 134 is disposed intermediate the switch 120 and the head flange 102, as illustrated. The lever 130 may be apertured in order to enable passage of the retaining means 112 and the post 114 therethrough. The lever 130 may be resiliently flexible, with the first end 132 fixedly secured to the neck flange 102, and the body of the lever (intermediate the ends 132, 134 thereof) resiliently flexing to enable the neck flange 102 to depress the free end 134 against switch 120. Alternatively, the lever 130 may be rigid with the first end 132 resiliently pivotably secured to the head flange 102 so that the lever body and free end 134 can be tilted and displaced downwardly (against a restoring force) towards switch 120 by the head flange 102.

Operation of the neck switch is simple. When the child kisses the doll 10' on the lips or otherwise tilts the head portion 100 rearwardly and downwardly relative to the body portion 104, the forcible tilting overcomes the biasing means 112 and allows the head flange 102 to push switch 120 (either directly or indirectly via the second lever end 134 when the lever 130 is present), thus actuating the switch 120. When the child terminates the kiss or otherwise releases the head portion 100, the biasing means 112 acts to push the head and body portions 100, 104 apart, thereby moving the head flange 102 (and second lever end 134, if present) away from the switch 120 and thus deactuating the switch 120. Additionally, the biasing means tends to restore the balance of the head portion 100 atop the body portion 104.

To summarize, the present invention provides a doll with an eyeblink mechanism which is realistic and includes safety means for preventing and minimizing damage to the eyeblink mechanism when the eyeblink is physically restrained by the user. Where the doll is a talking doll, the eyeblink mechanism preferably operates off the same drive as that which moves the mouth of the doll, but blinks the eye in a realistic manner at irregular intervals and with full blinks. The doll may also have an improved kiss-initiated neck switch affording limited head rotation, limited articulation of the head in any axis, and limited telescopic action of the head relative to the body and characterized by a high level of strength to resist breakage.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A doll with an eyeblink mechanism, comprising:

(A) an eye with a reciprocatable eyelid movable between an eye open position and an eye closed position;

(B) drive means for providing intermittent slow rotary motion;

(C) driven means for intermittently relatively rapidly reciprocating said eyelid to blink said eye through one complete cycle from an eye open position, through an eye closed position and back to the open eye position, with the eye remaining in the eye open position for a greater period of time than in the eye closed position;

(D) torsion spring means operatively secured to both said drive means and said driven means for developing torque therebetween, said torsion spring means accumulating a predetermined threshold quantity of such rotary motion and converting each accumulated predetermined threshold quantity of such rotary motion into intermittent, relatively rapid reciprocating motion of said driven means, said torsion spring means being wound by such rotary motion when such reciprocating motion is blocked and unwound by the conversion of such rotary motion to such reciprocating motion, said torsion spring means additionally including means for releasably blocking such reciprocating motion until a predetermined threshold quantity of such rotary motion is accumulated.

2. The doll of claim 1 additionally including safety means for precluding overwinding of said torsion spring means.

3. The doll of claim 1 wherein said doll is a talking doll having a movable mouth and a mouth-driving mechanism for moving the mouth in general coordination with the talking of the doll, said mouth-driving mechanism being driven by said motion providing means.

4. A doll with an eyeblink mechanism, comprising:

(A) an eye with a reciprocatable eyelid;

(B) rotary disk means;

(C) drive means for intermittently slowly rotating said rotary disk means in a given direction;

(D) rotatable crank disk means for intermittently relatively rapidly reciprocating said eyelid when said crank disk means rotates, thereby to blink said eye;

(D) fixedly disposed stop means engageable with said crank disk means for normally precluding rotation of said crank disk means;

(E) biasing means biasing one of said stop means and said crank disk means into engagement with the other;

(F) torsion spring means secured to both said rotary disk and said crank disk means for developing torque therebetween and causing relatively rapid rotation of said crank disk means in a given direction when the engagement of said stop means and said crank disk means is released; and (G) means for overcoming said biasing means once per revolution of said rotary disk means, thereby to release the engagement between said stop means and said crank disk means and thus permit rotation of said crank disk means and blinking said eye once per revolution of said rotary disk means.

5. The doll of claim 4 additionally including a safety mechanism for precluding overwinding of said torsion spring means.

6. The doll of claim 5 wherein said safety mechanism includes a soft connection between said crank disk means and said eyelid which enables rotation of said crank disk means without reciprocating said eyelid, and means for causing a full rotation of said crank disk means at least once per full rotation of said rotary disk means regardless of whether or not rotation of said crank disk means reciprocates said eyelid.

7. A talking doll with an eyeblink mechanism, comprising:

(A) an eye with a reciprocatable eyelid;

(B) rotary disk means;

(C) drive means for intermittently slowly rotating said rotary disk means in a given direction;

(D) rotatable crank disk means for intermittently relatively rapidly reciprocating said eyelid when said crank disk means rotates, thereby to blink said eye;

(D) fixedly disposed stop means engageable with said crank disk means for normally precluding rotation of said crank disk means;

(E) biasing means biasing one of said stop means and said crank disk means into engagement with the other;

(F) torsion spring means secured to both said rotary disk and said crank disk means for developing torque therebetween and causing relatively rapid rotation of said crank disk means in a given direction when the engagement of said stop means and said crank disk means is released;

(G) means for overcoming said biasing means once per revolution of said rotary disk means, thereby to release the engagement between said stop means and said crank disk means and thus permit rotation of said crank disk means and blinking said eye once per revolution of said rotary disk means; and (H) safety mechanism means for precluding overwinding of said torsion spring means, said safety mechanism means including a soft connection between said crank disk means and said eyelid which enables rotation of said crank disk means without reciprocating said eyelid, and means for causing a full rotation of said crank disk means at least once per full rotation of said rotary disk means regardless of whether or not rotation of said crank disk means reciprocates said eyelid.

8. The doll of claim 7 wherein said doll is a talking doll including a movable mouth, and said drive means also moves said mouth in general coordination with the talking.

9. The doll of claim 7 including a head, a body, and a neck physically connecting said head and body together while permitting limited relative rotational movement thereof, said neck including a neck switch responsive to a predetermined relative movement of said head and said body.

* * * * *